US009522762B2

(12) United States Patent
Kim

(10) Patent No.: US 9,522,762 B2
(45) Date of Patent: Dec. 20, 2016

(54) CONTAINER CAPABLE OF BEING COUPLED HORIZONTALLY AND VERTICALLY AT A TIME

(71) Applicant: Sunrise Co., Ltd., Hwaseong-si, Gyeonggi-do (KR)

(72) Inventor: Sang-Kee Kim, Daegu (KR)

(73) Assignee: SUNRISE CO., LTD. (KR)

( * ) Notice: Subject to any disclaimer, the term of this patent is extended or adjusted under 35 U.S.C. 154(b) by 0 days.

(21) Appl. No.: 14/688,159

(22) Filed: Apr. 16, 2015

(65) Prior Publication Data

US 2015/0232230 A1 Aug. 20, 2015

Related U.S. Application Data

(63) Continuation of application No. PCT/KR2013/009202, filed on Oct. 15, 2013.

(30) Foreign Application Priority Data

Oct. 17, 2012 (KR) ..... 10-2012-0115617
Nov. 12, 2012 (KR) ..... 10-2012-0127757
Jun. 7, 2013 (KR) ..... 10-2013-0065111

(51) Int. Cl.
*B65D 21/036* (2006.01)
*B65D 21/02* (2006.01)

(52) U.S. Cl.
CPC ..... *B65D 21/0222* (2013.01); *B65D 21/0204* (2013.01)

(58) Field of Classification Search
CPC ..... B65D 21/0222; B65D 21/0204
USPC ..... 206/508
See application file for complete search history.

(56) References Cited

U.S. PATENT DOCUMENTS 6,152,318 A 11/2000 Walker

FOREIGN PATENT DOCUMENTS

| | | | |
|---|---|---|---|
| KR | 20-0328902 | Y1 | 10/2003 |
| KR | 20-0406689 | Y1 | 1/2006 |
| KR | 10-2007-0107712 | A | 11/2007 |
| KR | 20-0439210 | Y1 | 3/2008 |
| KR | 10-2009-0096058 | A | 9/2009 |
| KR | 10-2010-0106947 | A | 10/2010 |
| KR | 10-2012-0113845 | A | 10/2012 |

OTHER PUBLICATIONS

WIPO, International Search Report (PCT/KR2013/009202), Dec. 11, 2013.

*Primary Examiner* — Stephen Castellano
(74) *Attorney, Agent, or Firm* — Park & Associates IP Law, P.C.

(57) ABSTRACT

A container includes a main body having a receiving space and an opening; and a cover covering the opening of the main body. The main body has a rib divided and a groove portion between the parts of the rib, the cover has at least two track-shaped coupling grooves into which a rib of a main body of another container of same shape is inserted and which are spaced apart from each other, and has a track-shaped airtight groove in an edge portion of an opposite surface of the cover to allow the coupling grooves to be put therein. An edge of the opening of the main body is inserted into the airtight groove, and a spaced portion between two track-shaped coupling grooves of a cover of another container is inserted into the groove portion of the rib of the main body.

7 Claims, 9 Drawing Sheets

CONTAINER CAPABLE OF BEING COUPLED HORIZONTALLY AND VERTICALLY AT A TIME

REFERENCE TO RELATED APPLICATIONS

This is a continuation of pending International Patent Application PCT/KR2013/009202 filed on Oct. 15, 2013, which designates the United States and claims priority of Korean Patent Application No. 10-2012-0115617 filed on Oct. 17, 2012, Korean Patent Application No. 10-2012-0127757 filed on Nov. 12, 2012, and Korean Patent Application No. 10-2013-0065111 filed on Jun. 7, 2013, the entire contents of which are incorporated herein by reference.

FIELD OF THE INVENTION

The present invention relates to a container, and more particularly, to a container capable of being coupled horizontally and vertically at a time. Further, the present invention relates to a container of which airtightness is improved by coupling.

BACKGROUND OF THE INVENTION

Generally, a container includes a main body storing food therein and a cover covering the main body. When multiple containers are received in a refrigerator or the like, the containers are arranged horizontally and stacked vertically.

Herein, in order to firmly fix the vertically stacked containers, the main body of an upper container is coupled to the cover of a lower container, for example, as described in Korean Patent Laid-Open Publication Nos. 2010-0106947 and 2009-0096058.

However, the general container has a structure stacked vertically only but not considering coupling between the horizontally arranged containers.

Further, since air flow is not generated between boundary surfaces of the vertically stacked containers, there is a limitation that, for example, when the containers are received in a refrigerator, cold air is not transferred to food placed at upper and lower sides of the boundary surfaces of the stacked containers.

SUMMARY OF THE INVENTION

An object of the present invention is to provide a container which allows multiple containers to be capable of being coupled horizontally and vertically at a time.

Another object of the present invention is to provide a container capable of being coupled horizontally and vertically at a time, which ensures a sufficient mechanical strength of a cover and also has a simple structure.

A further another object of the present invention is to provide a container capable of being coupled horizontally and vertically at a time, which allows air to be smoothly flowed between boundary surfaces of the multiple containers A further another object of the present invention is to provide a container capable of being coupled horizontally and vertically at a time, of which airtightness is improved by coupling.

According to an aspect of the present invention, there is provided a container capable of being coupled horizontally and vertically at a time, the container including: a main body having a receiving space defined therein and an opening; and a cover covering the opening of the main body, wherein the main body has a rib divided into at least two parts and protruding along an edge portion of a lower surface thereof, and a groove portion defined between the at least two parts of the rib, the cover has, in a surface thereof, at least two track-shaped coupling grooves into which a rib of a main body of another container having the same shape as the rib of the main body of the container is inserted and which are spaced apart from each other, and has a track-shaped airtight groove defined in an edge portion of an opposite surface of the cover in a size which allows the coupling grooves to be put therein, an edge of the opening of the main body is inserted into the airtight groove, and a spaced portion defined between two track-shaped coupling grooves of a cover of another container having the same shape as the cover of the container is inserted into, or adjacent edge portions of covers of two different containers which are disposed adjacent to each other are inserted into the groove portion of the rib of the main body of the container.

According to another aspect of the present invention, there is provided a container capable of being coupled horizontally and vertically at a time, the container including: a main body having a receiving space defined therein and an opening; and a cover covering the opening of the main body, wherein the main body has a rib divided into at least two parts and protruding along an edge portion of a lower surface thereof, and a groove portion defined between the at least two parts of the rib, the cover has, in a surface thereof, at least two track-shaped coupling grooves into which a rib of a main body of another container having the same shape as the rib of the main body of the container is inserted, an air flowing space is defined at an inside enclosed by the rib, and a groove portion is disposed at a portion that divides the rib, and an air flow channel connecting the groove portion to the air flowing space is defined, and a spaced portion defined between two track-shaped coupling grooves of a cover of another container having the same shape as the cover of the container is inserted into, or adjacent edge portions of covers of two different containers which are disposed adjacent to each other are inserted into the groove portion of the rib of the main body of the container.

According to another aspect of the present invention, there is provided a container capable of being coupled horizontally and vertically at a time, the container including: a main body having a receiving space defined therein and an opening; and a cover covering the opening of the main body, wherein a rib divided into at least two parts protrudes along a pair of opposed edge portions of a lower surface of the main body, a coupling groove into which a rib of a main body of another container having the same shape as the rib of the main body of the container is inserted is formed in an upper surface of the cover to extend in the same direction as a direction of disposing the rib, a track-shaped airtight groove having a size which allows the coupling groove to be put therein is defined in an edge portion of a lower surface of the cover, an edge of an opening of the main body is inserted in the airtight groove, and upper edge portions of covers of two different containers which are disposed adjacent to each other are simultaneously inserted into a divided portion of the rib of the main body.

According to another aspect of the present invention, there is provided a container capable of being coupled horizontally and vertically at a time, the container including: a main body having a receiving space defined therein and an opening; and a cover covering the opening of the main body, wherein at least two pairs of ribs protruding in a first direction and spaced apart to be opposed to each other are disposed in a second direction vertical to the first direction, a coupling groove into which the ribs are inserted is defined in an upper surface of the cover to correspond to the ribs, a track-shaped airtight groove having a size which allows the coupling grooves to be put therein is defined in an edge portion of a lower surface of the cover, an edge of an opening of the main body is inserted in the airtight groove, and a distance between one pair of ribs and the other pair of adjacent ribs is the same as or larger than a width of an upper surface edge portion of the cover of adjacent container.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE INVENTION

Now, preferred embodiments of the present invention will be described in detail with reference to the accompanying drawings.

Figure 1:
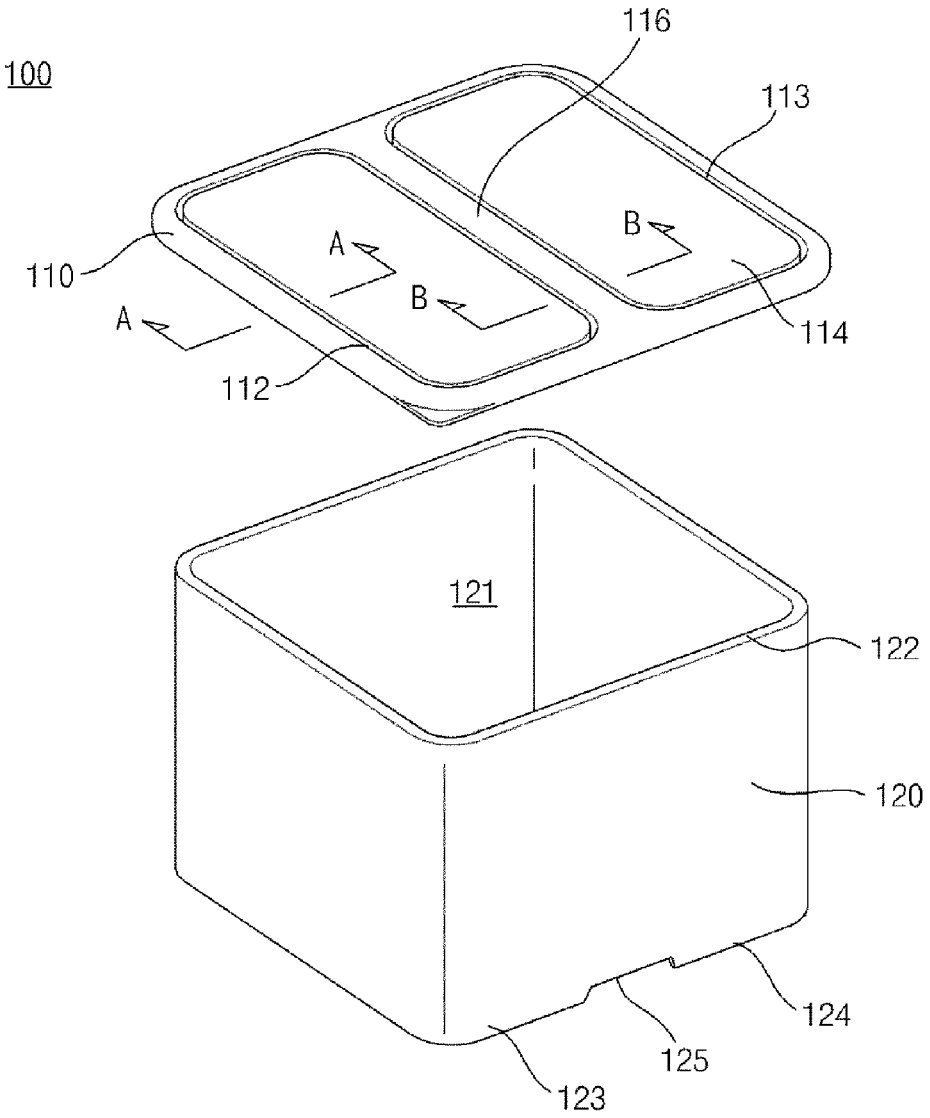
FIG. 1 is an exploded perspective view of a container according to an embodiment of the present invention.
Figure 1A:
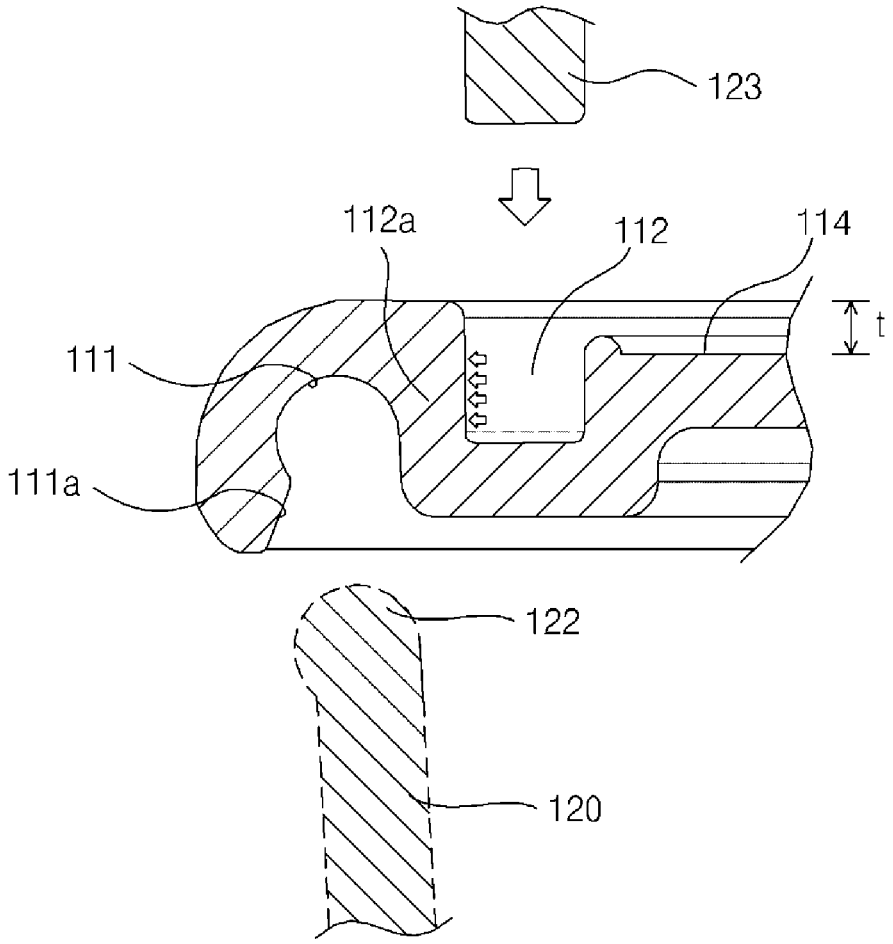
FIGS. 1A and 1B are cross-sectional views taken along lines A-A and B-B of FIG. 1, respectively.
Figure 1B:
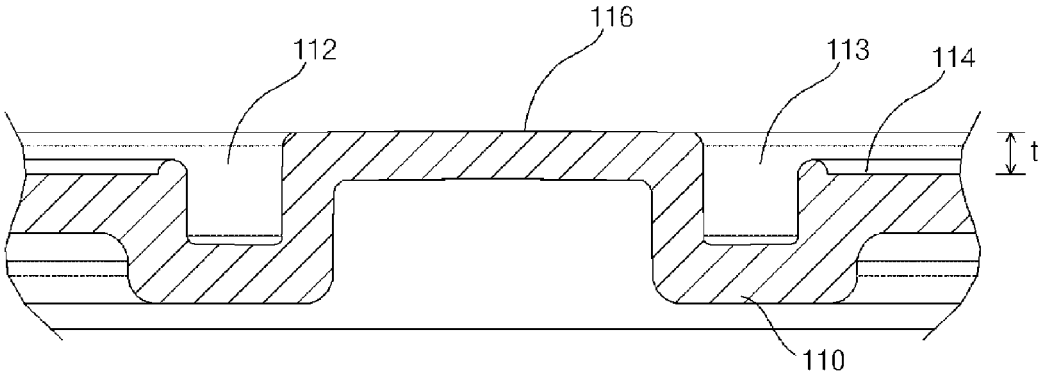
Figure 2:
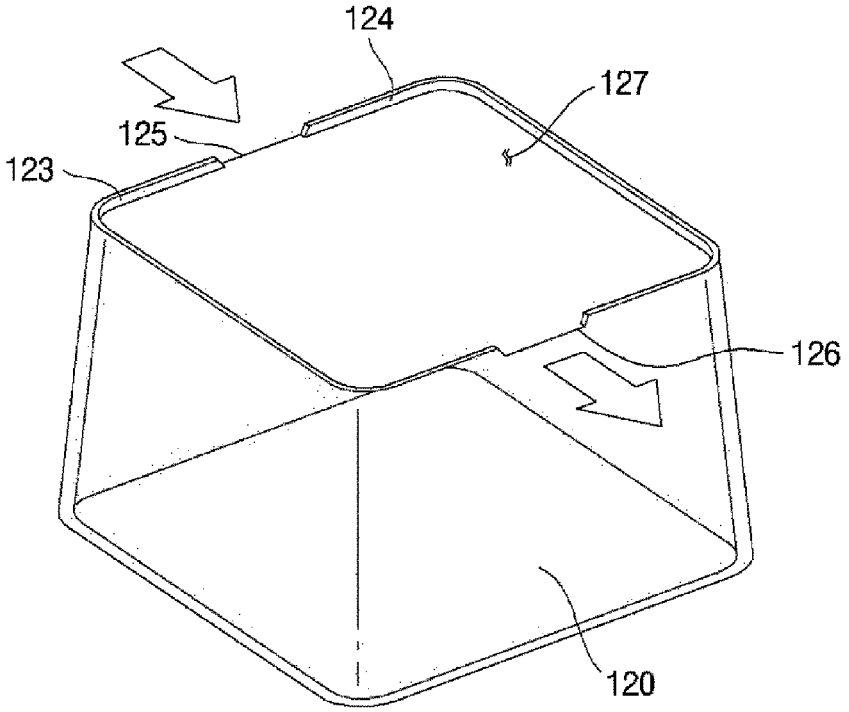
FIG. 2 is a perspective view of a main body of the container of FIG. 1, which is turned upside down.

FIG. 1 is an exploded perspective view of a container according to an embodiment of the present invention, FIGS. 1A and 1B are cross-sectional views taken along lines A-A and B-B of FIG. 1, respectively, and FIG. 2 is a perspective view of a main body of the container of FIG. 1, which is turned upside down.

Referring to FIG. 1, the container 100 includes a main body 120 storing food therein and a cover 110 covering the main body 120.

The main body 120 is provided into a single body, has an opening in one side thereof, and has a hexahedral shape on the whole to define a receiving space 121 therein.

Further, each sidewall of the main body 120 may be inclined to be wider toward the upper side thereof.

Referring to FIG. 2, ribs 123 and 124 protrude along an edge portion of a lower surface of the main body 120, and divided to be opposed to each other. In this embodiment, the ribs 123 and 124 are configured to be symmetric with respect to each other, but not limited thereto. Thus, the ribs 123 and 124 may have different sizes.

Each of groove portions 125 and 126 is formed at a portion dividing the ribs 123 and 124 so that air may flow along a lower surface of the main body 120, as indicated by an arrow.

As described later, the groove portions 125 and 126 correspond to a boundary area 116 defined by the cover 110 of another container stacked at the lower side thereof. It is necessary to sufficiently ensure a height of each of the groove portions 125 and 126 and thus provide a sufficient space between a surface of the boundary area 116 and the lower surface of the main body 120 of an upper container.

An air flowing space 127 is defined on the lower surface of the main body 120 by the protruding ribs 123 and 124, and an air flowing channel connecting the groove portion 125, the air flowing space 127, and the groove portion 126 to each other is defined by the groove portions 125 and 126 communicating with the air flowing space 127.

In this embodiment, the ribs 123 and 124 are divided into two parts, and thus the two groove portions 125 and 126 are defined, but the present invention is not limited thereto. The ribs 123 and 124 may be divided into multiple parts, and thus a plurality of groove portions may be defined.

Referring to FIGS. 1, 1A, and 1B, the cover 110 is provided into a single body, and coupling grooves 112 and 113 in the form of a track are defined in a pair in a surface of the cover 110, and an airtight groove 111 in the form of a track is also defined along an edge portion of the surface of the cover 110.

In this embodiment, the coupling grooves 112 and 113 and airtight groove 111 are connected in the form of a track, but the present invention is not limited thereto. They are entirely in the form of a track, but each of the grooves 111, 112, and 113 may be divided at at least one place thereof.

Referring to FIGS. 1 and 1A, the airtight groove 111 has a desired size which puts the coupling grooves 112 and 113 therein, and the airtight groove 111 and coupling grooves 112 and 113 are respectively provided in the opposite surfaces to each other.

In this embodiment, each of the coupling grooves 112 and 113 has a square shape in vertical section, and the airtight groove 111 has a circular shape in vertical section, but the present invention is not limited thereto.

As described above, since the airtight groove 111 has a circular shape in vertical section, an edge 122 of the opening 121 of the main body 120 has also a circular shape in vertical section.

An inclined portion 111*a* spread downward is formed at the entrance of the airtight groove 111 so that the edge 122 of the opening 121 may be easily inserted therein.

As described above, the airtight groove 111 and coupling grooves 112 and 113 are respectively provided in the opposite surfaces to each other, and in an aspect of the vertical installation position, the coupling grooves 112 and 113 are disposed adjacent to the airtight groove 111.

In this case, as shown in FIG. 1A, if the rib 123 of the other main body 120 is inserted into the coupling grooves 112 and 113 while the edge 122 of the opening 121 of the main body 120 is inserted into the airtight groove 111, a boundary wall 112*a* defined between the airtight groove 111 and the coupling grooves 112 and 113 is pressed toward the airtight groove 111 by the rib 123, and thus the edge 122 of the opening of the main body 120 is more firmly coupled to the airtight groove 111, thereby airtightly sealing the inside of the main body 120.

Referring to FIG. 1A, the surface of the cover 110 includes a depressed area 114 enclosed by the coupling grooves 112 and 113 and a boundary area 116 defined between the coupling grooves 112 and 113. The depressed area 114 is defined to be lower than the boundary area 116 by a height t so that the air flowing space 127 may be sufficient, and the ribs 123 and 124 of the other main body 120 may be easily inserted.

Further, a depth of each of the coupling grooves 112 and 113 is smaller than a height of each of the ribs 123 and 124 so that the air flowing space 127 may be formed more largely.

In this embodiment, the two coupling grooves 112 and 113 are formed in the surface of the cover 110, but the present invention is not limited thereto. At least one coupling groove may be defined in the surface of the cover 110.

Figure 3A:
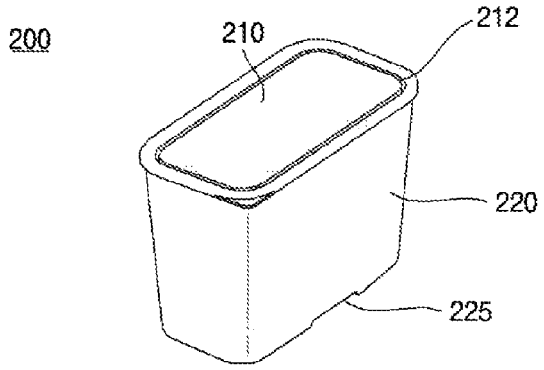
FIGS. 3A, 3B, and 3C are perspective views illustrating examples of various kinds of containers.
Figure 3B:
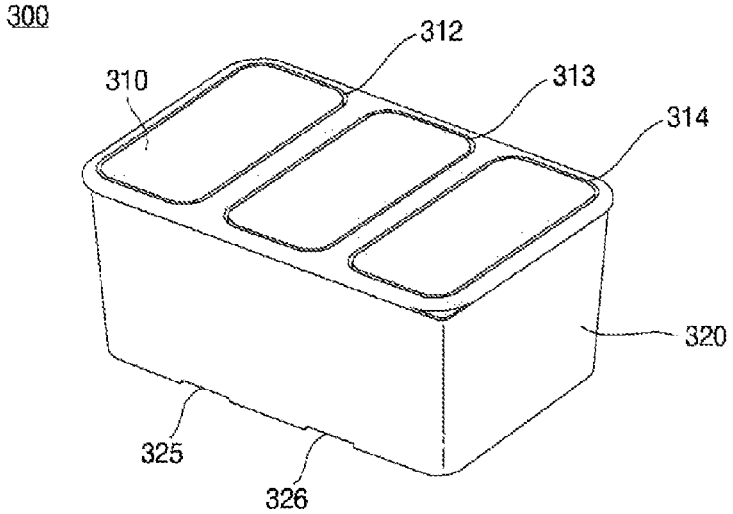
Figure 3C:
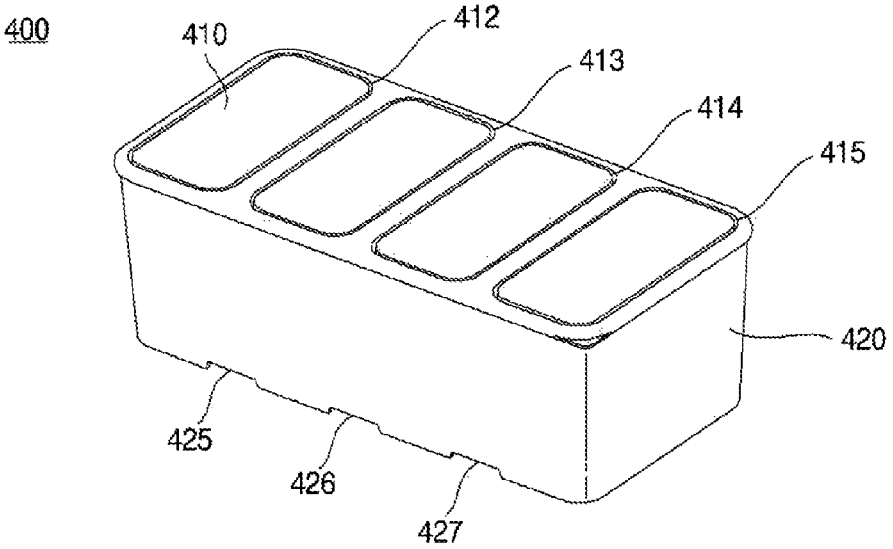

FIGS. 3A, 3B, and 3C are perspective views illustrating examples of various kinds of containers.

FIG. 3A shows a container 200 which includes a main body 220 formed with one groove portion 225 and one coupling groove 212, and FIG. 3B shows a container 300 which includes a main body 320 formed with two groove portions 325 and 326 and three coupling grooves 312, 313, and 314, and FIG. 3C shows a container 400 which includes a main body 320 formed with three groove portions 425, 426, and 427 and four coupling grooves 412, 413, 414, and 415.

Herein, the sizes of the coupling grooves and groove portion are the same as in each container. Thus, each of the containers 100, 200, 300, and 400 shown in FIGS. 1, 3A, 3B, and 3C are arranged in proper combination and coupled horizontally and vertically at a time.

Figure 4:
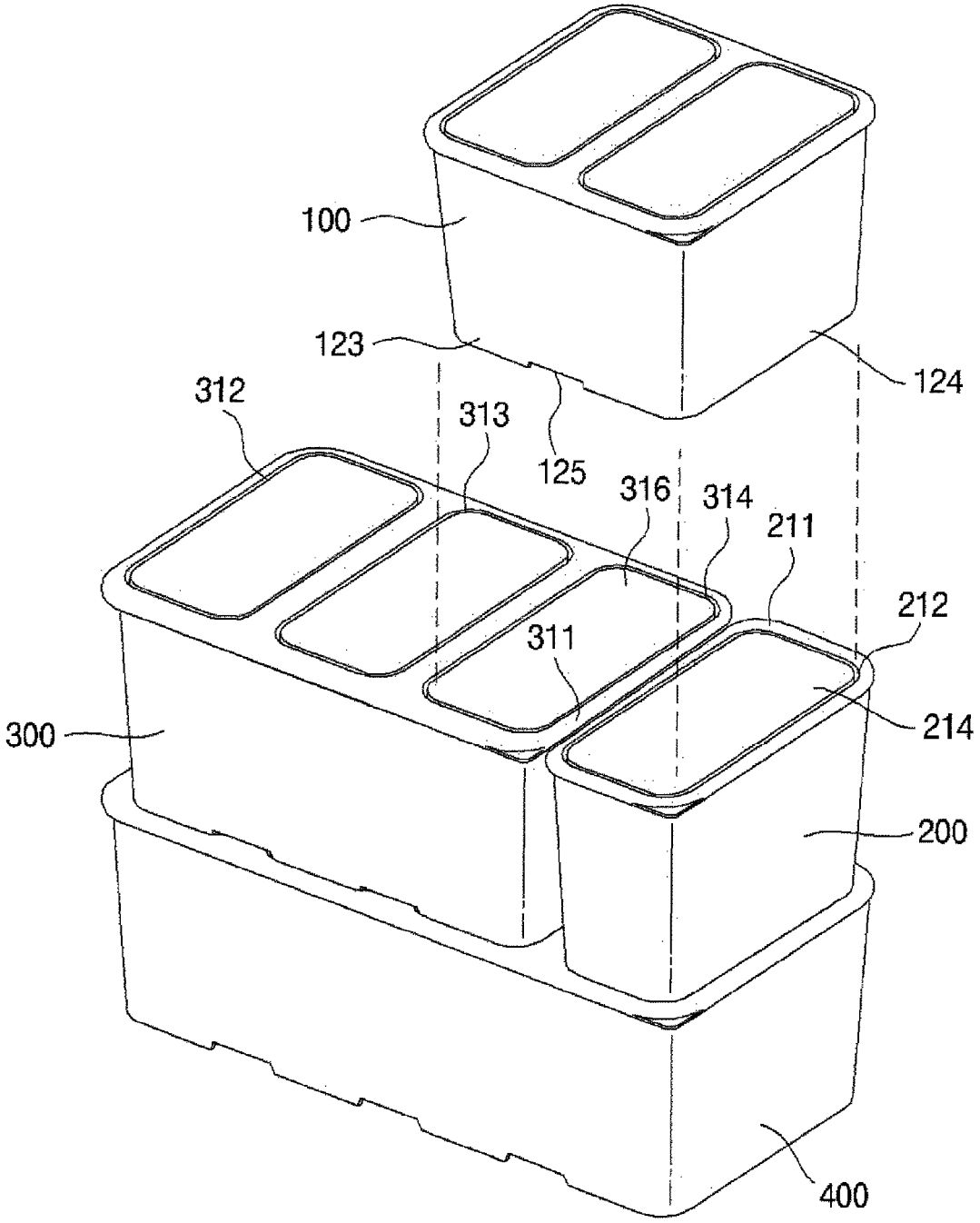
FIG. 4 is a perspective view illustrating a state that multiple containers of FIG. 1 are coupled vertically and horizontally with one another.

FIG. 4 is a perspective view illustrating a state that multiple containers of FIG. 1 are coupled vertically and horizontally with one another.

The container 200 and container 300 are parallelly disposed and coupled on the largest container 400, and the container 100 is vertically stacked on the containers 200 and 300.

Hereinafter, for convenience for explanation, a method of stacking the container 100 on the containers 200 and 300 will be described.

The edge of the opening of each of the main bodies 120, 220, and 320 of the containers 100, 200, and 300 is inserted into each of the airtight grooves 120, 220, and 320, thereby previously coupling the containers 100, 200, 300 with one another.

The ribs 123 and 124 of the container 100 are inserted into the coupling groove 314 of the container 300 and the coupling groove 212 of the container 100, respectively.

Herein, a surface edge portion 211 of the container 200 and a surface edge portion 311 of container 300 are simultaneously inserted in the groove portion 125 formed between the ribs 123 and 124. As described above, since the height of each of the ribs 123 and 124 is larger than the depth of each of the coupling grooves 212 and 314, and each of areas 214 and 316 enclosed by the coupling grooves 212 and 314 is lower than each of the surface edge portions 211 and 311 of the containers 200 and 300, a gap is formed from the groove portion 125 to each of the surface edge portions 211 and 311 of the containers 200 and 300, and air flows therethrough.

If the coupling is completed, as described above, the containers 100, 200, 300, and 400 are vertically coupled with one another, and also since the separated containers 200 and 300 are bound to each other by the container 100, the horizontal coupling is achieved.

As a result, the containers 100, 200, 300, and 400 are vertically and horizontally coupled at a time, thereby providing the reliable coupling.

Also, since the air flowing space is defined among the boundary surfaces of the containers 100, 200, 300, and 400, and at the same time, air flow is generated through the groove portion, air may be smoothly flowed among the containers 100, 200, 300, and 400, even though the containers are in a body. Therefore, for example, when the containers are received in a refrigerator, cold air flows among the containers and the chill may be uniformly transferred to food placed at the boundary surfaces.

Also, when the ribs 123 and 124 of the container 100 are inserted into the coupling grooves 212 and 314, respectively. Also, sidewalls of the coupling grooves 212 and 314 are pressed, and thus the airtight groove formed in an opposed surface of the containers 200 and 300 becomes narrower, thereby improving the airtightness.

Figure 5:
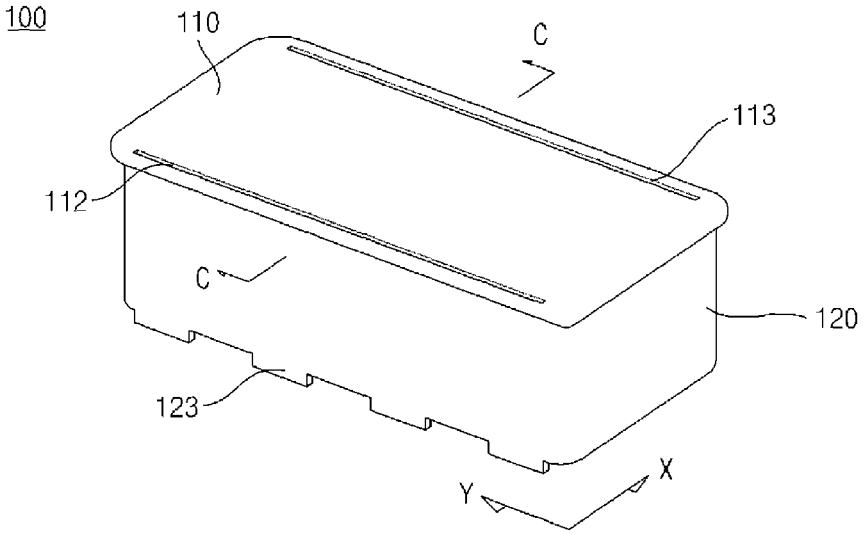
FIG. 5 is a perspective view of a container according to another embodiment of the present invention.
Figure 5A:
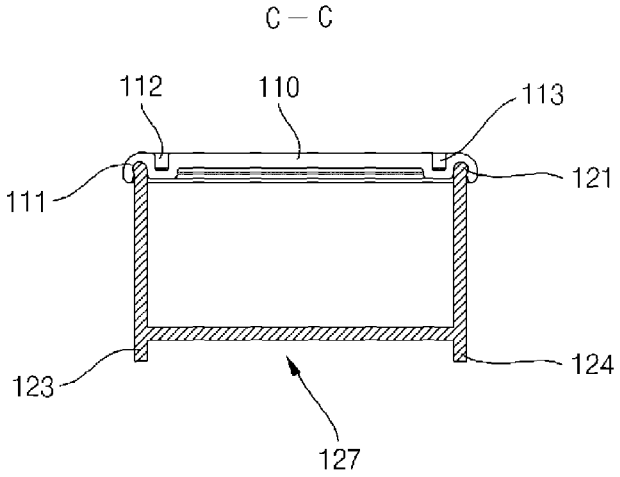
FIG. 5A is a cross-sectional view taken along a line C-C.

FIG. 5 is a perspective view of a container according to another embodiment of the present invention, and FIG. 5A is a cross-sectional view taken along a line C-C. Hereinafter, for convenience of explanation, an X direction is defined as a transversal direction, and a Y direction is defined as a longitudinal direction.

According to this embodiment, multiple ribs 123 and 124 are disposed on the edge portions of the lower surface of the main body 120, which are opposed in a transversal direction to protrude and extend along a longitudinal direction at regular intervals.

As a result thereof, the air flowing space 127 is defined by the lower surface of the main body 120 and the ribs 123 and 124, and a portion between the ribs 123 and 124 functions as a groove portion, and thus there is defined an air channel in which external air is introduced to or discharged from the air flowing space 127 through the groove portion.

Referring to FIG. 5, a cover 110 is provided into a single body. Coupling grooves 112 and 113 in which the ribs 123 and 124 of the other main body 120 are inserted are defined along a longitudinal direction on an upper surface of the cover 110 to correspond to positions that the ribs 123 and 124 are defined.

In this embodiment, the coupling grooves 112 and 113 are continuously defined along the longitudinal direction, but the present invention is not limited thereto. Instead, the coupling grooves 112 and 113 may be discontinuously defined to precisely correspond to the ribs 123 and 124.

Further, the same structure as in FIG. 1A is provided in the lower surface of the cover 110, and thus a coupling groove 111 in the form of a track is formed along an edge portion thereof. The detailed description thereof will be omitted.

Figure 6:
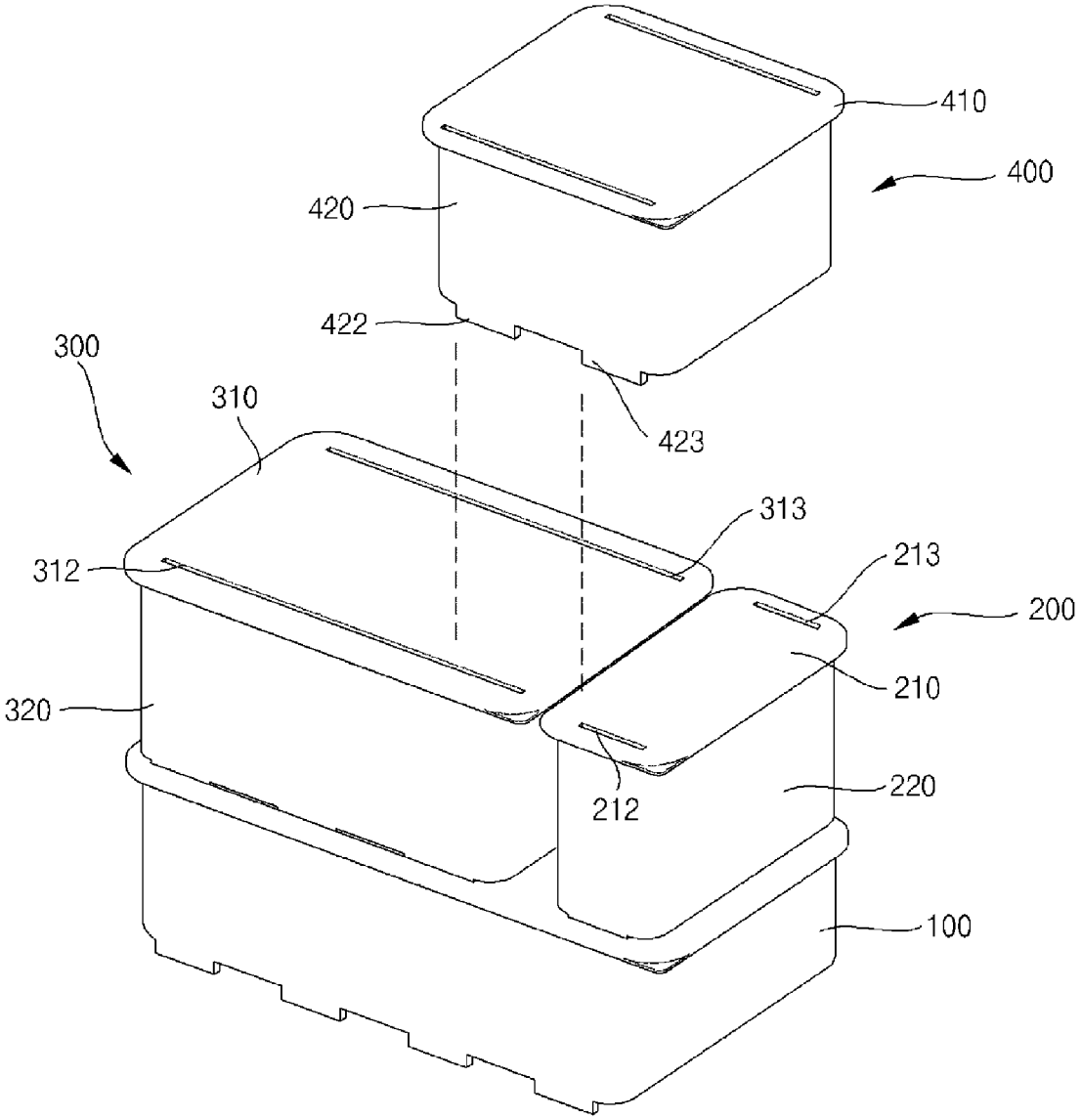
FIG. 6 is a perspective view illustrating a state that multiple containers of FIG. 5 are coupled vertically and horizontally with one another.

FIG. 6 is a perspective view illustrating a state that multiple containers of FIG. 5 are coupled vertically and horizontally with one another.

The containers 200 and 300 are parallelly coupled and disposed on the largest container 100 placed at the lowermost position, and the container 400 is vertically stacked on the containers 200 and 300 to commonly overlap the containers 200 and 300.

Hereinafter, for convenience of explanation, a method of stacking the container 400 on the containers 200 and 300 will be described.

In each of the containers 100, 200, and 300, the edge of the opening of each of the main bodies 120, 220, and 320 is previously inserted into the airtight groove formed in the lower surface of each of the covers 110, 210, and 310.

The ribs 422 and 423 of the container 400 are inserted into the coupling grooves 212 and 312 of the containers 200 and 300, respectively.

Herein, the upper edge portions of the covers 210 and 310 of the containers 200 and 300 are simultaneously inserted into a spaced portion between the ribs 422 and 423, and thus the containers 200 and 300 are vertically stacked on the container 100, and at the same time, horizontally coupled by the container 400. As a result thereof, the containers 100, 200, 300, and 400 are vertically and horizontally in a body, thereby providing the reliable coupling.

Herein, as described above, since the height of each of the ribs 422 and 423 of the container 400 is larger than the depth of each of the coupling grooves 212 and 312, external air may be introduced into a space between a lower surface of the container 400 and upper surfaces of the containers 200 and 300 through the spaced portion between the ribs 422 and 423.

As described above, since the air flowing space 127 is formed at a vertical boundary portion of each of the vertically coupled containers 100, 200, 300, and 400, and the spaced portions among the ribs of the vertically stacked containers 200, 300, and 400 function as groove portions connecting the air flowing space 127 and the outside, air may be smoothly flowed among the containers 100, 200, 300, and 400, even though the containers 100, 200, 300, and 400 are in a body. Therefore, for example, when the containers 100, 200, 300, and 400 are received in a refrigerator, cold air is flowed among the containers and the chill may be uniformly transferred to food placed at the boundary surfaces.

Figure 7:
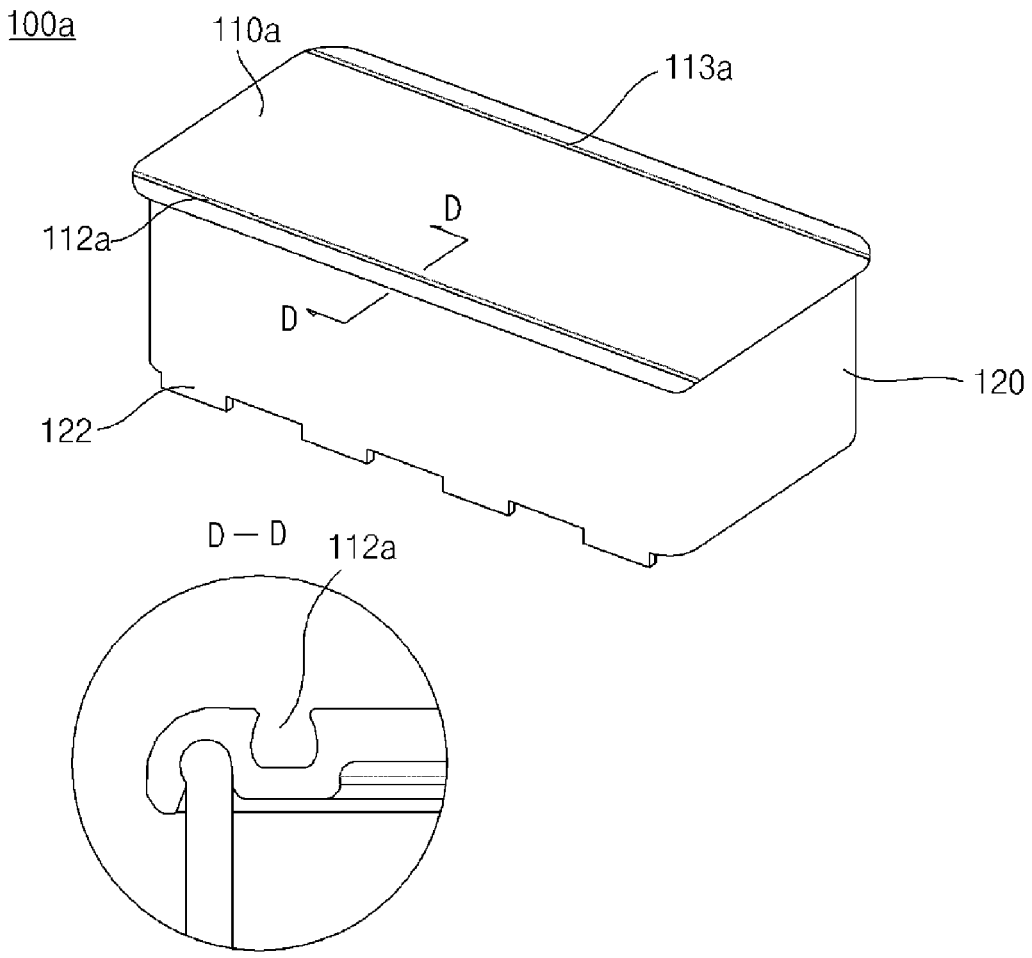
FIG. 7 is a perspective view illustrating a modified example of FIG. 5.

FIG. 7 is a perspective view illustrating a modified example of FIG. 5.

In a container 100*a* shown in FIG. 7, coupling grooves 112*a* and 113*a* provided in a pair in an upper surface of a cover 110*a* is formed in a longitudinal direction to be extended to both ends. When seeing from the both ends, it is configured so that the coupling grooves 112*a* and 113*a* are connected to the outside.

Another container to be stacked on the cover 110*a* may be fitted from an upper side, or may be coupled by sliding horizontally from one end of the coupling grooves 112*a* and 113*a*.

Herein, a cross-section of each of the coupling grooves 112*a* and 113*a* is in the form of a pot which is expanded convexly toward a lower side thereof, and a cross-section of a rib 122 inserted therein has a similar shape in order to prevent the rib 122 inserted into the coupling grooves 112*a* and 113*a* from being easily separated.

Figure 8:
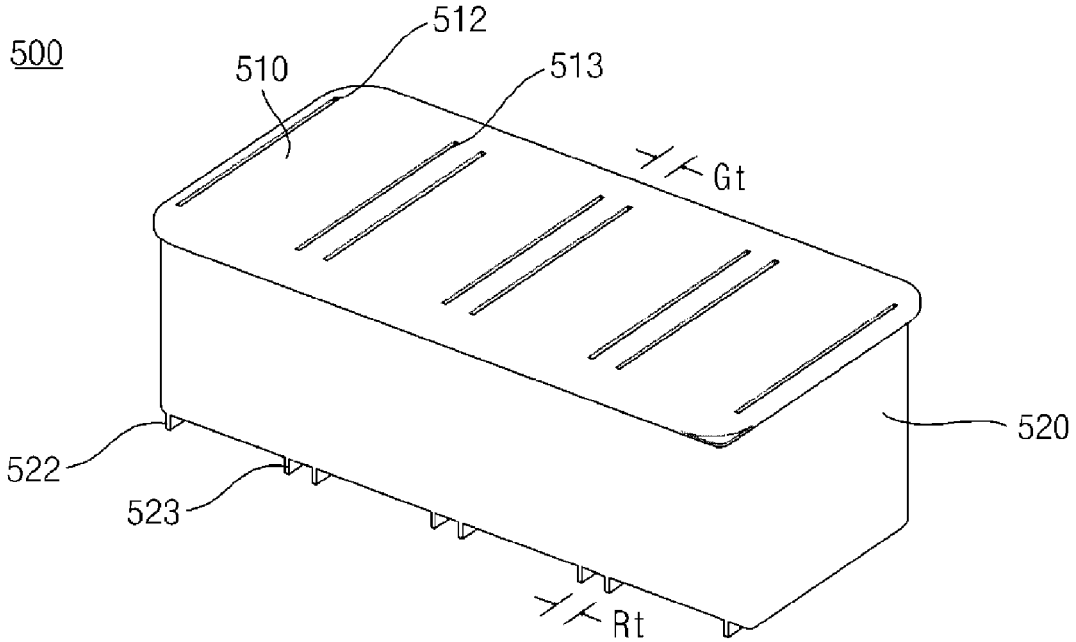
FIG. 8 is a perspective view of a container according to another embodiment of the present invention.

FIG. 8 is a perspective view of a container according to another embodiment of the present invention.

According to this embodiment, ribs 522 and 523 extended in a transversal direction and formed in a pair are disposed on a lower surface of a main body 520 to be spaced apart at regular intervals Rt in a longitudinal direction.

Further, coupling grooves 512 and 513 extended in a transversal direction and formed in a pair are defined in an upper surface of a cover 510 to be spaced apart at regular intervals Gt in a longitudinal direction.

Herein, as shown in FIG. 8, the intervals Rt and Gt should be the same. Also, the intervals may be properly designed considering a length of the cover protruded from a sidewall of the main body, such that an adjacent container may be coupled horizontally.

Further, in this embodiment, the groove portion may be disposed at a portion that the ribs 522 and 534 are not provided, for example, both ends in a transversal direction.

According to the above-mentioned structure, since the multiple containers are coupled horizontally and vertically at a time, the containers in a body may be reliably coupled with each.

Also, since the air flowing space is formed on the boundary surface of each of the vertically coupled containers, and at the same time, the air flow is generated through the groove portion, air may be smoothly flowed between the containers, even though the containers are in a body.

Also, since the coupling groove formed in the cover is formed continuously or discontinuously in the transversal or longitudinal direction, the strength of the cover may be maintained, even though the groove is formed.

Also, since the multiple containers are coupled to each other, airtightness therebetween may be further improved.

While the present invention has been described in detail, it should be understood that various changes, substitutions and alterations may be made hereto without departing from the spirit and scope of the invention as defined by the appended claims.

What is claimed is:

1. A container capable of being coupled horizontally and vertically at a time to form a stackable container set with a plurality of containers of similar shape, the container comprising:

a main body having an opening and a receiving space defined therein; and a cover for covering the opening of the main body, wherein the main body has a plurality of ribs protruding along an edge portion of a lower surface of the main body, and an upwardly recessed portion defined between the ribs, wherein the cover has, on an upper surface thereof, at least two or more coupling grooves, each of said coupling grooves having a closed loop shape into which at least one of said plurality of ribs of a main body of another container is inserted, the shape of each one of said plurality of ribs corresponding to at least a portion of the closed loop shape of the coupling groove, the coupling grooves being spaced apart from each other with a boundary area defined there-between, wherein the cover has an airtight groove of closed loop shape defined in an edge portion of a lower surface of the cover in a size and shape which allows the coupling grooves to be enclosed within a circumferential boundary of the airtight groove, wherein an upper edge of the opening of the main body is configured to be inserted into the airtight groove, and wherein the boundary area between two adjacent coupling grooves of a cover of another container of similar shape is inserted into the upwardly recessed portion of the main body of the container, or adjacent edge portions of covers of two containers which are disposed adjacent to each other are inserted into the upwardly recessed portion of the main body of the container.

2. The container of claim 1, wherein a height of the ribs is larger than a depth of each of the coupling grooves.

3. The container of claim 1, wherein an upper surface area enclosed by the coupling grooves of the cover is formed to be lower than other areas thereof the edge portions and the boundary area of the upper surface of the cover.

4. The container of claim 1, wherein a downwardly inclined portion is disposed at an entrance of the airtight groove.

5. The container of claim 1, wherein the airtight groove of the cover encloses the coupling grooves within the circumferential boundary of the airtight groove so that a wall is formed between the airtight groove and the coupling grooves, and the wall is to be pressed toward the airtight groove by the ribs inserted into the coupling grooves.

6. The container of claim 1, wherein the airtight groove has a circular shape in vertical section, and the upper edge of the main body inserted into the airtight groove has a circular shape in vertical section, and an inclined portion spread downward is disposed at an entrance of the airtight groove.

7. The container of claim 1, wherein an air flowing space is defined at a bottom surface of the main body enclosed by the rib, and an air flow channel is formed to allow an air flow between the upwardly recessed portions and the air flowing space.

* * * * *